United States Patent [19]

Dudley et al.

[11] Patent Number: 4,649,953

[45] Date of Patent: Mar. 17, 1987

[54] SIPHON ASSEMBLY FOR FLUSHING CISTERNS

[75] Inventors: Thomas I. Dudley, Stourbridge; Harold J. T. Dudley, Wolverhampton, both of United Kingdom

[73] Assignee: Thomas Dudley Limited, Dudley, England

[21] Appl. No.: 799,395

[22] Filed: Nov. 19, 1985

[30] Foreign Application Priority Data

Nov. 30, 1984 [GB] United Kingdom ..... 8430361

[51] Int. Cl.[4] ..... F04F 10/00

[52] U.S. Cl. ..... 137/148; 4/368; 137/151; 137/153; 285/24

[58] Field of Search ..... 4/368, 376, 375; 137/123, 151, 152, 153, 148, 149; 285/24, 27, 124, 157, 283, 404

[56] References Cited

U.S. PATENT DOCUMENTS

| | | | |
|---|---|---|---|
| 3,470,900 | 10/1969 | Rothauser | 258/157 X |
| 3,815,941 | 6/1974 | Synder | 285/283 |

FOREIGN PATENT DOCUMENTS

| | | | |
|---|---|---|---|
| 801655 | 9/1958 | United Kingdom | 137/148 |
| 2083851 | 3/1982 | United Kingdom | 137/151 |
| 2092197A | 8/1982 | United Kingdom . | |

*Primary Examiner*—Gerald A. Michalsky
*Attorney, Agent, or Firm*—C. O. Marshall, Jr.

[57] ABSTRACT

Siphon assembly for a flushing cistern is in two parts; the first including the down leg of the siphon duct the lower end of which is mounted in the cistern base and the second including the up leg and the inlet chamber in which the flushing piston is received. The parts are releasably connected by a push fit spigot and socket joint secured by a removable pin received transversely through locating formations on each part near the tops of the legs, further formations near the bottoms of the legs being received in vertical sliding relationship.

9 Claims, 2 Drawing Figures

SIPHON ASSEMBLY FOR FLUSHING CISTERNS

This invention relates to syphon assemblies for flushing cisterns of the kind comprising an inverted generally U-shape duct having an upleg and a downleg, the upleg being provided with an enlarged chamber at its open lower end which receives a vertically displaceable piston by means of which, in use, a syphonic action is initiated in a well known manner, the down leg of said duct forming an outlet at a position offset laterally with respect to the chamber.

Syphon assemblies of this kind may comprise major components which are manufactured as plastics mouldings, and the piston commonly incorporates a flexible diaphragm of, for example, rubber or plastics material acting as a oneway valve. Such a syphon assembly is hereinafter referred to as "a syphon assembly of the kind referred to".

The assembly is mounted within the cistern in use, usually by the outlet end of the duct down leg being provided with a screw connection enabling it to be secured in the base of the cistern in registry with a flush pipe or passage leading to a W.C. pan and, when the assembly is so mounted, a downwardly presented open mouth of the cistern chamber needs to be spaced a short distance above the floor of the cistern to admit water into the assembly.

The piston may require maintenance from time to time, particularly for replacement of the diaphragm and, where the main body of the assembly is formed in one-piece or permanently bonded together, this can be a time consuming task particularly in the case of close coupled W.C. suites because it may be necessary to dismount the cistern from the pan and then remove the syphon assembly from the cistern before access to the piston can be obtained.

In our British Pat. No. 2083851 dated Sept. 4th 1981 we describe and claim a syphon assembly formed in at least two portions which are releasably connected so that one portion including the chamber and piston can be removed from the cistern leaving the remaining portion or portions in position therein so as to avoid the need for the extensive dismantling referred to above.

The object of the present invention is to provide a syphon assembly of the kind referred to which is in two or more dismantleable portions to provide the facility for maintenance referred to in our said patent, and which is particularly convenient to manufacture and assemble, which utilises certain components of common design for a range of types of assembly, and which is durable and reliable in use.

According to the invention a syphon assembly of the kind referred to comprises a first portion including the duct down leg having a lower end formation adapted to be mounted in the base of the cistern to locate the assembly operatively therein, a second portion including the duct up leg provided with the chamber, and securing means releasably locating said portions in operative relationship with fluid tight connection between the legs of the duct, said means comprising a releasable connection between first formations on each portion adjacent to the operatively upper ends of the up leg and down leg and second formations on each portion adjacent to the operatively lower ends of said legs which are mutually engageable and shaped to provide mating profiles maintaining the legs in parallel or other predetermined lateral relationship.

Said releasable connection may comprise a removable pin received in aligned bores of the first formations and/or the second formations may be slidingly engaged longitudinally of the legs.

Preferably one of said portions, typically the second portion, includes an integral or permanently attached inverted U-section of the duct forming the fluid connection between the up leg and down leg thereof, and the ducts of said portions are operatively connected by a spigot and socket joint, possibly with the interposition of a resilient "O" ring or other fluid tight sealing element.

Preferably the axis of engagement of said spigot and socket joint is operatively vertical and may comprise the upper end of the down leg duct so that the fluid tight engagement will be unaffected by any slight relative vertical displacement of the portions in use e.g. due to pull on the piston during flushing or any slight relative angular displacement thereof about the connecting pin or other said releasable connection due to play and manufacturing tolerances in the securing means.

Said portions may be formed as integral or composite mouldings of plastics material and the sliding or other mutual engagement of the second formations is such as to enable the assembly together of first and second portions selected from a range of sizes enabling up legs and down legs of differing effective lengths to be combined together e.g. to suit various types or styles of cistern with substantial economies in tooling costs and component stocking requirements.

An example of the invention is now more particularly described with reference to the accompanying drawings wherein.

Figure 1:
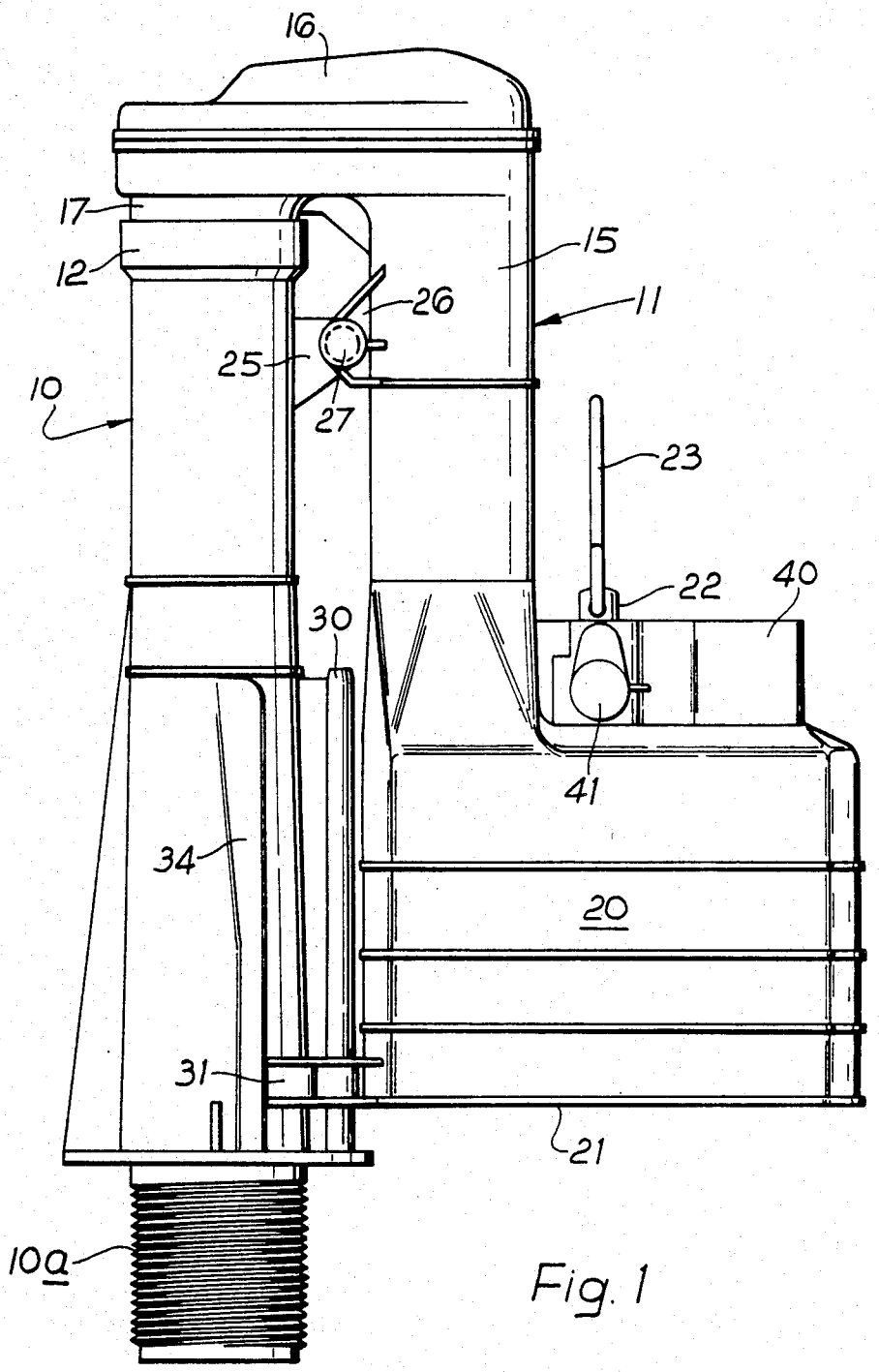
FIG. 1 is an elevation of an assembled syphon assembly.
Figure 2:
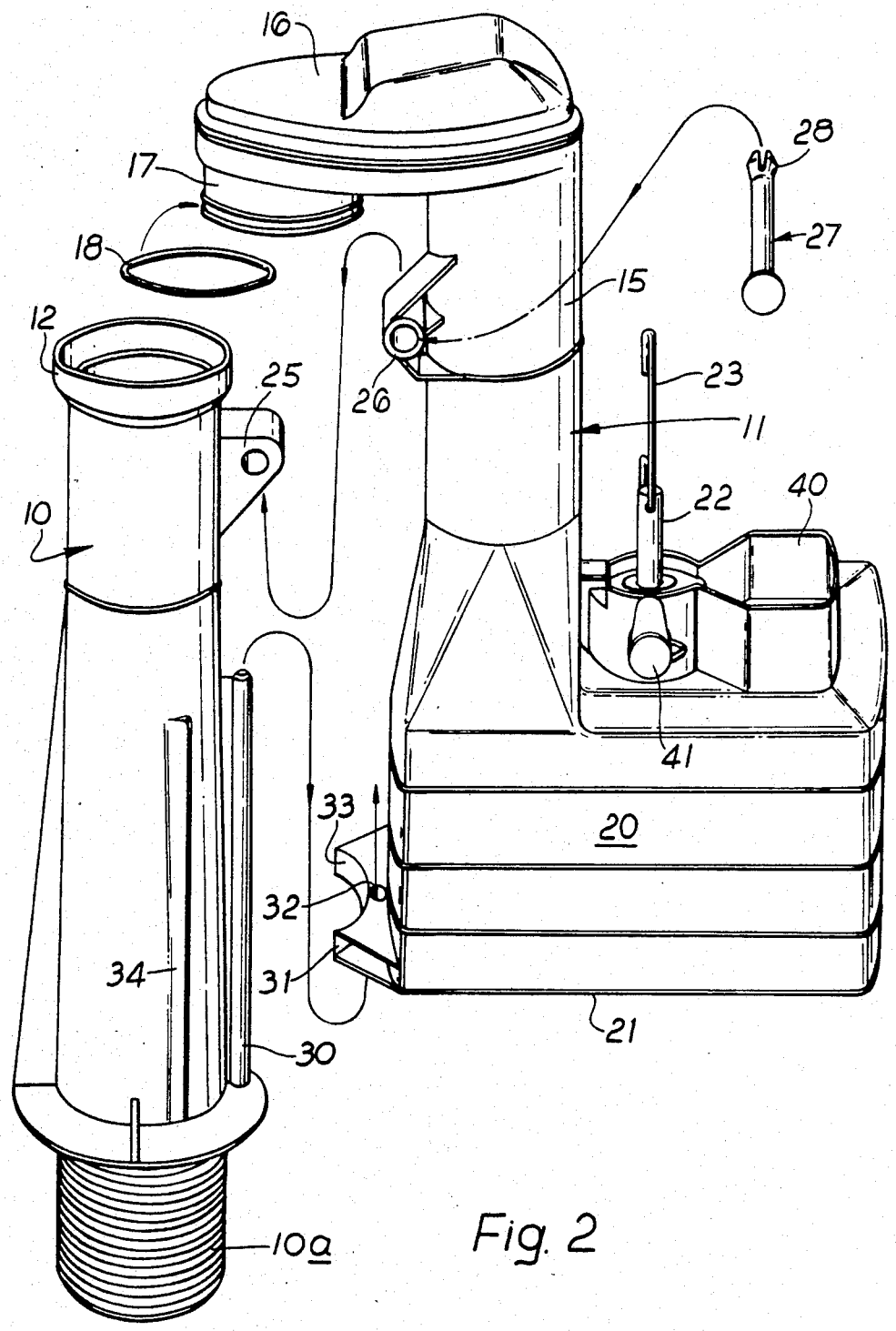
FIG. 2 is an exploded perspective view thereof.

The syphon assembly is formed from plastics mouldings, the major components being first and second portions 10, 11.

First portion 10 constitutes the down leg of the assembled syphon U-shaped duct and is generally tubular, being provided with an externally threaded screw connection 10*a* at its lower end which will be secured in the base of the cistern in use to mount the assembly therein and also form an outlet connection to a flush pipe or passage leading into a W.C. pan. The upper end of portion 10 is formed as an increased diameter socket 12.

Second portion 11 comprises a cylindrical up leg duct 15 leading to an inverted U top section 16, the other limb of the U being a cylindrical spigot 17 which is operatively received in the socket 12 of the first portion, fluid tight sealing thereof being assured by an "O" ring 18.

The lower part of the up leg of portion 11 is a generally rectangular chamber 20 having a downwardly directed open mouth 21 within which is positioned a piston and flexible diaphragm (not shown) of known kind operated by a vertical pull rod 22 and link 23 which will be connected to a flushing lever of the cistern in use.

On assembly the up leg and down leg are aligned in spaced parallel relationship with the mouth 21 of chamber 20 adjacent to the lower end of portion 10 and positioned just above the floor of the cistern.

The two portions are releasably secured together by securing means now described in detail.

Each portion is provided with first formations in the form of respective lugs 25, 26 which project laterally towards each other from one side of the upper end of portion 10 and one side of the upper end of the up leg 15 of portion 11 respectively.

When the portions are aligned in assembled relationship with spigot 17 entered into socket 12 bores in lugs 25 and 26 are aligned so that a headed pin 27 having an enlarged diameter bifurcated end 28 can be snap engaged through the lugs to retain them together.

The securing means further comprises mating second formations adjacent the lower ends of the two portions. Portion 10 is provided with a vertical longitudinally extending rib 30 along approximately the lower half of its length projecting towards the side wall of chamber 20 on assembly. This rib is shaped to a male profile by having, in cross section, an enlarged circular head portion connected to the main body of the down leg duct by a reduced cross section web.

A mating female formation 31 is provided on the lower edge portion of a wall of chamber 20 having a central keyhole section slot 32 forming a female profile which is slidingly engageable with rib 30 but which prevents relative lateral displacement of the two portions. To increase the stability of the interconnection, formation 31 extends laterally to each side of slot 32 to provide a concave face 33 which abuts the cylindrical outer surface of portion 10 between locating ribs 34 thereof.

The two portions can be readily assembled and disassembled without dismantling the cistern or disconnecting first portion 10 therefrom by withdrawing pin 27 and then sliding portion 11 upwards so that spigot 17 is drawn clear of socket 12, the upward movement being continued until slot 32 of formation 31 clears the upper end of the rib 30. The entire second portion can then be removed from the cistern together with the piston and diaphragm for maintenance or replacement.

Portions 10 may be formed in various sizes i.e. of lengths to suit various patterns of cistern, and can be assembled together with second portions 11 having up legs of different lengths, the variations in length being accommodated by the sliding engagement of formation 31 with the rib 30. Thus the spacing of the mouth 21 from the floor of the cistern may be varied according to the components used and/or the effective length of the down leg duct can be varied using a range of standard components and without special adaptation.

As in our said patent 2083851 forces acting on chamber 20, e.g. as pull rod 22 is being operated, are transmitted to the first portion 10 and hence the cistern structure mainly through the pin 27, pivoting moments about that pin being resisted by the engagement between the second formations 30 and 31 without any substantial transmission of force to or through the spigot and socket joint connecting the duct.

It is to be noted that as the axis of the spigot and socket joint is vertical any upward or downward forces causing slight relative displacement will act along that axis and will not cause any damage or breaking of the fluid seal as the spigot 17 can ride inside socket 12. Moreover any slight pivotal movement about pin 27 due to clearance or manufacturing tolerances in the interengageable formations will generally be by way of anti-clockwise movement of second portion 11 as viewed in the drawings due to upward pull on rod 22 and this will have the effect of shifting spigot 17 into slightly deeper engagement with socket 12.

In order to prevent any substantial amount of air being sucked in the top opening in chamber 20 in which pull rod 22 slides an open topped well 40 is moulded on the top of chamber 20 to retain a reservoir of water surrounding the rod.

To provide controlled venting of the top of chamber 20 to facilitate operation with high and low level suites a two-part removable plug 41 is provided. With both parts of the plug inserted an opening in the chamber wall is entirely closed, but a central solid part of the plug can be removed to leave a restricted aperture through a remaining part of the plug for low level flushing, and the entire plug can be removed to leave a larger aperture for high level flushing, the two parts of the plug being interconnected by an integral flexible plastics band and the parts being marked with instructions for removal as above.

We claim:

1. A siphon assembly for a flushing cistern having a base containing a flush passage, comprising a generally inverted-U-shaped duct having parallel up and down legs within the cistern in use, the up leg having an enlarged chamber at its lower end with a downwardly presented open mouth which is spaced a short distance above the base of the cistern in use and the down leg having a lower outlet end adapted to be secured in the base of the cistern to mount the assembly therein in use with said outlet end connected to said flush passage, said chamber containing a vertically displaceable piston incorporating a oneway valve by means of which, in use, a siphonic action is initiated to discharge the contents of the cistern through said flush passage by way of said duct, and said duct being formed in two releasably interconnected portions comprising a first duct portion including the down leg, and a separable second portion including the chamber, whereby the second duct portion can be removed from the cistern without dismounting the first duct portion, wherein the improvement comprises:

(a) the second duct portion including a permanently attached inverted U section of the duct forming a fluid connection between the up and down legs, (b) a push-in fluid tight spigot and socket connection on a vertical axis between an upper end of the first duct portion down leg and a limb of said U section of the second duct portion, (c) each duct portion having a first formation adjacent the upper end of the respective leg but vertically spaced from the spigot and socket connection, said first formations being in aligned relationship with each other when said connection is fully made, and disengageable securing means for interengaging said formations to prevent vertical displacement of the duct portions relative to each other, and (d) a second formation adjacent the lower end of each duct portion, said second formations being shaped for mated sliding engagement longitudinally of the legs at a position remote from the first formations, while preventing any substantial angular displacement of the legs relative to each other about the axis of engagement of the first formations due to vertical forces acting on the chamber from operation of the piston, yet allowing the duct portions to be detached from each other for removal of the second duct portion from the cistern by lifting it upwards when said securing means is disengaged.

2. An assembly as in claim 1 wherein said first formations include bores and the securing means is a removable pin received in said bores when in aligned relationship.

3. An assembly as in claim 1 wherein said second formations include a longitudinally extending rib along a lower part of one of said duct portions having a male profile including, in cross section, an enlarged head portion connected to said one duct portion by a reduced cross section web, and the second formation of the other of said duct portions has a mating female profile in the form of a longitudinally extending keyhole section slot for sliding engagement with said male profile.

4. An assembly as in claim 3 wherein said male profile extends a substantial distance along said one duct portion whereby other duct portions of various overall lengths can be engaged therewith.

5. An assembly as in claim 3 wherein the second formation of said other duct portion extends laterally to each side of said slot and is formed with a face which conforms to the outer surface of said one duct portion when the second formations are engaged, to provide increased lateral stability.

6. An assembly as in claim 3 wherein said one duct portion is the first duct portion and said other duct portion is the second duct portion.

7. An assembly as in claim 6 wherein the second formation of the second duct portion is located at the lower end of the up leg chamber.

8. An assembly as in claim 1 wherein the up and down legs and the inverted U section of the duct are all mouldings of plastics material, the first and second formations forming integral parts of said mouldings.

9. An assembly as in claim 1 wherein the spigot and socket connection is provided with a resilient fluid tight sealing element.

* * * * *